US006839695B2

(12) United States Patent
Igval

(10) Patent No.: US 6,839,695 B2
(45) Date of Patent: Jan. 4, 2005

(54) POSTAGE METER LOCATION SYSTEM

(75) Inventor: Yakup J. Igval, Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 595 days.

(21) Appl. No.: 09/848,707

(22) Filed: May 3, 2001

(65) Prior Publication Data

US 2002/0165835 A1 Nov. 7, 2002

(51) Int. Cl.[7] ..... G07B 17/00
(52) U.S. Cl. ..... 705/410; 283/71; 283/116
(58) Field of Search ..... 283/71, 116; 705/401, 705/408, 410

(56) References Cited

U.S. PATENT DOCUMENTS

| | | | | |
|---|---|---|---|---|
| 5,638,283 | A | 6/1997 | Herbert | 364/464.2 |
| 5,655,024 | A | 8/1997 | Bell et al. | 380/51 |
| 5,657,689 | A | 8/1997 | Lee | 101/91 |
| 5,737,423 | A | 4/1998 | Manduley | 380/25 |
| 5,812,400 | A | 9/1998 | Eddy et al. | 364/464.2 |
| 5,812,536 | A | 9/1998 | Manduley | 370/282 |
| 5,852,813 | A | 12/1998 | Guenther et al. | 705/408 |
| 5,943,658 | A | 8/1999 | Gravell et al. | 705/410 |
| 2001/0047278 | A1 * | 11/2001 | Brookner et al. | 705/1 |
| 2002/0165835 | A1 * | 11/2002 | Igval | 705/401 |

FOREIGN PATENT DOCUMENTS

| | | |
|---|---|---|
| EP | 0665517 A2 * | 8/1995 |
| EP | 0825566 A2 * | 2/1998 |
| EP | 0854449 A2 * | 7/1998 |

OTHER PUBLICATIONS

"Automated Paper Mail Sorting and Delivery Route Determination": IBM Technical Disclosure Bulletin, Sep. 1, 1993, vol 36, No. 9B, pp. 447–448.*
MoversNet, Your Official Change of Address Form, website . usps.gov/moversnet/coa.htm1.
Geographic Intelligence, Digital Island, website .digisle.net/services/app_serv/traceware.shtml.
Quova, Geopoint, website at .quova.com.

* cited by examiner

*Primary Examiner*—Edward R. Cosimano
(74) *Attorney, Agent, or Firm*—Angelo N. Chaclas; George M. Macdonald; Charles R. Malandra

(57) ABSTRACT

A postage meter system includes a postage meter and a data center. The postage meter is registered to a specific customer at a designated location for printing a postal indicium on a mail piece. The data center is remotely located from the postage meter and includes a locator application and a customer account file corresponding to the postage meter. The customer account file includes specific customer identification data and designated location data. The postage meter enters selective operative communication with the data center via the internet for establishing a transaction session. During the transaction session, the data center: (i) employs the locator application to send homing signals back and forth between the postage meter and the data center along different routes through the internet and uses a communication parameter associated with the homing signals triangulate an actual location of the postage meter; (ii) compares the actual location with the designated location; and (iii) initiates updates to the postage meter system if the actual location and the designated location do not correspond.

27 Claims, 5 Drawing Sheets

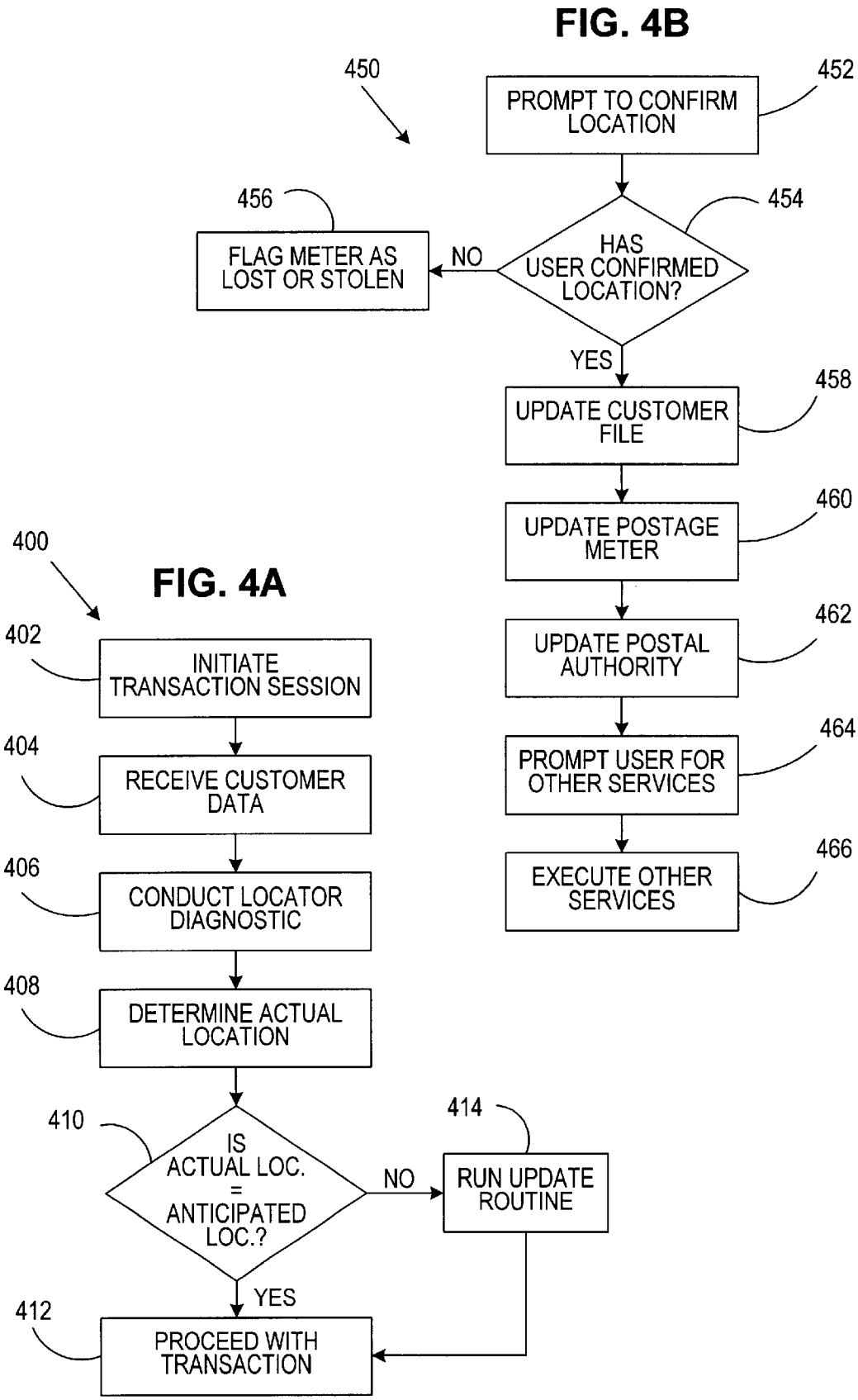
FIG. 4B
450
PROMPT TO CONFIRM LOCATION
452
HAS USER CONFIRMED LOCATION?
454
NO
FLAG METER AS LOST OR STOLEN
456
YES
UPDATE CUSTOMER FILE
458
UPDATE POSTAGE METER
460
UPDATE POSTAL AUTHORITY
462
PROMPT USER FOR OTHER SERVICES
464
EXECUTE OTHER SERVICES
466
FIG. 4A
400
INITIATE TRANSACTION SESSION
402
RECEIVE CUSTOMER DATA
404
CONDUCT LOCATOR DIAGNOSTIC
406
DETERMINE ACTUAL LOCATION
408
IS ACTUAL LOC. = ANTICIPATED LOC.?
410
NO
RUN UPDATE ROUTINE
414
YES
PROCEED WITH TRANSACTION
412

POSTAGE METER LOCATION SYSTEM

FIELD OF THE INVENTION

The present invention relates to postage metering systems and more particularly to a postage metering system having postage meter location detection capability.

BACKGROUND OF THE INVENTION

Postage meters are well known in the art. A typical postage meter stores and dispenses postage. Evidence that postage has been dispensed is most often in the form of a postal indicium that is printed on an envelope or other mail piece. As is well known, postage meters include an ascending register, that stores a running total of all postage dispensed by the meter, and a descending register that holds the remaining amount of postage credited to the meter. The descending register is reduced by the amount of postage dispensed during a transaction. The postage meter generally also includes a control sum register that provides a check upon the descending and ascending registers. The control sum register has a running account of the total funds having been added into the meter. The control sum register must always correspond with the summed readings of the ascending and descending registers. Thus, the control sum register is the total amount of postage ever put into the meter and it is alterable only when adding funds to the meter. In this manner, by inspecting the various registers and securing them from tampering, the dispensing of postal funds may be accurately recorded, tracked and accounted for.

It is typical of postal authorities, such as the United States Postal Service (USPS), to promulgate rules governing the placement, installation, registration and tracking of postage meters by postage meter manufacturers with users. For example, postal funds records for each postage meter may be maintained by the regional post offices wherein the postage meters are physically located. As such, the postage meter is typically registered (licensed) to a particular user at a specified location and assigned to a regional post office corresponding to the specified location. As another example, the postage meter is typically provided with the ability to print a geographic location indicator, such as a ZIP Code, as part of the postal indicium. In the United States, this geographic location indicator is part of the "town circle" information contained with the postal indicium and corresponds to the ZIP code of the regional post office where the postage meter is installed. Generally, postal authority rules require that the mail pieces be delivered to the corresponding regional post office. Thus, if a regional post office begins to receive a large volume of mail containing an incorrect geographic location indicator, then it may be an indication that the user or manufacturer has moved the postage meter from one location to another location. This necessitates an updating of the records that are kept by the postal authority and modification of the postage metering system by the manufacturer to update the geographic origin indicator.

These procedures, which may vary from country to country, provide a level of control and accountability for the use of the postage meter and assist the postal authority in their own internal processes. For example, revenue distribution to regional post offices depends on the accurate tracking of the locations of the postage meters and ensuring that each postage meter is registered to a licensing regional post office.

Many factors introduce inaccuracies into the list of postage meters and associated licensing post offices. Inaccuracies result in incorrect revenue distribution to such licensing post offices and less control over the postage meter population. As one example, recent advances in technology and postal regulations have dramatically reduced the physical size of the postage meters. As a result, the postage meters are more portable than ever before. With ease of movement, the user may be unaware of or may not remember about the regulations governing such relocation. As another example, lost and stolen postage metering systems are a continuing problem for both postage meter manufacturers and the postal authorities. While some of these losses are a direct result of fraudulent activity, it is believed that many are due to procedural oversights due to, for example, a customer relocation, sale of a business, incorrect address on a form, database mismatches and the like.

Therefore, there is a need for a postage meter system including geographic location capability that provides for efficiency of operation in tracking the whereabouts of individual postage meters.

SUMMARY OF THE INVENTION

The present invention resolves discrepancies between an actual location (i.e. address, town, county, region, etc.) of a postage meter and a designated location for the postage meter.

It has been found that the present invention reduces the chance of rejected mail after a meter move. The present invention provides an indication and support for meter regulation compliance. It has further been found that the present invention provides better tracking of meters within each licensing post office, and an accurate distribution of customer postal funds to the correct licensing post office.

In accordance with the present invention, a postage meter system includes a postage meter and a data center. The postage meter is registered to a specific customer at a designated location for printing a postal indicium on a mail piece. The data center is remotely located from the postage meter and includes a locator application and a customer account file corresponding to the postage meter. The customer account file includes specific customer identification data and designated location data. The postage meter enters selective operative communication with the data center via the internet for establishing a transaction session. During the transaction session, the data center: (i) employs the locator application to send homing signals back and forth between the postage meter and the data center along different routes through the internet and uses a communication parameter associated with the homing signals triangulate an actual location of the postage meter; (ii) compares the actual location with the designated location; and (iii) initiates updates to the postage meter system if the actual location and the designated location do not correspond.

In accordance with the present invention, a method of operating a postage meter system and a method of operating a data center are also provided.

Therefore, it should now be apparent that the invention substantially achieves all the above objects and advantages. Additional objects and advantages of the invention will be set forth in the description that follows, and in part will be obvious from the description, or may be learned by practice of the invention. Moreover, the objects and advantages of the invention may be realized and obtained by means of the instrumentalities and combinations particularly pointed out in the appended claims.

DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

FIG. 4A is a flow chart of the operation of the postage meter system in accordance with the present invention.

FIG. 4B is a flow chart of an update procedure executed by the postage meter system in accordance with the present invention.

DETAILED DESCRIPTION OF THE PRESENT INVENTION

Figure 1:
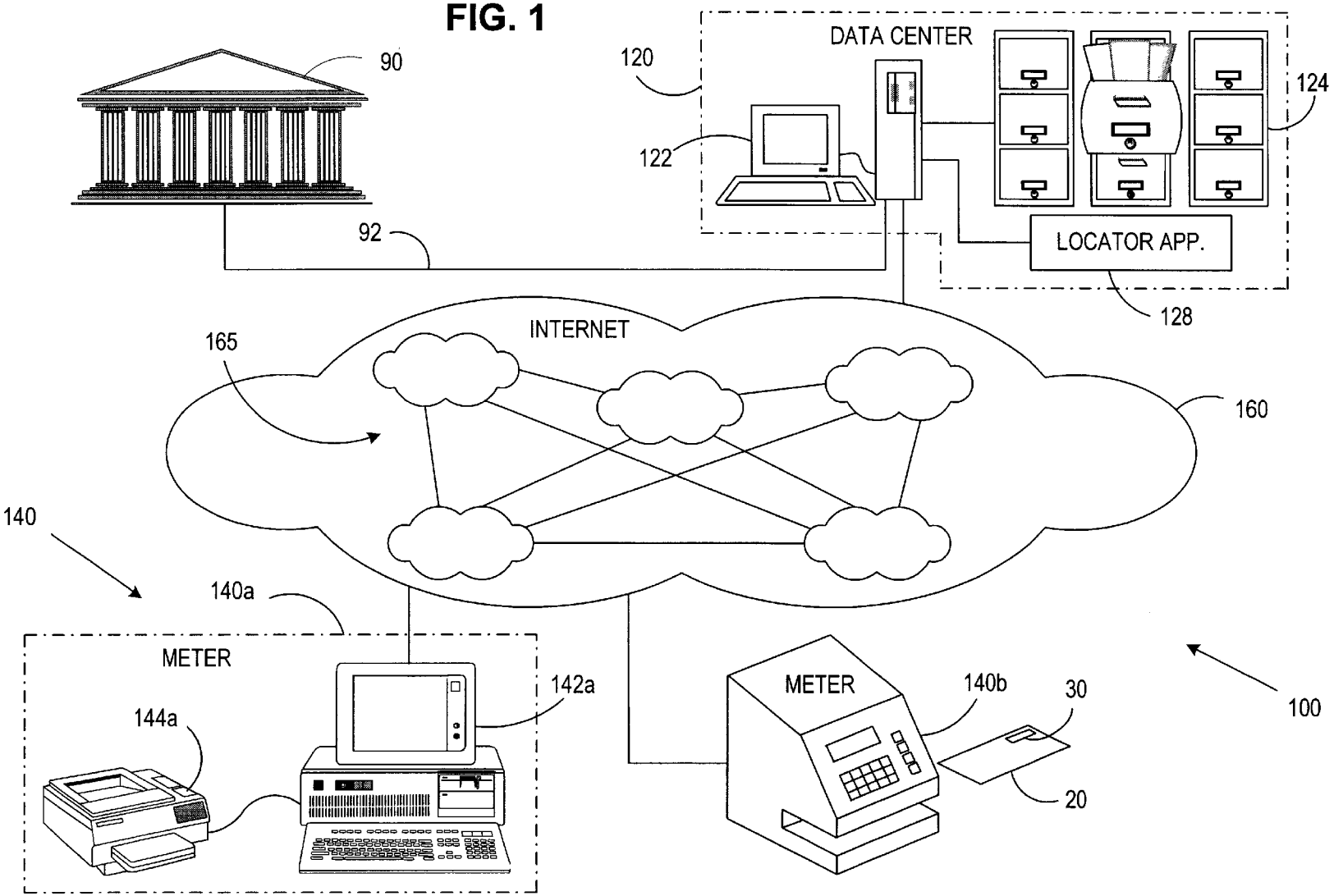
FIG. 1 is a schematic representation of a postage metering system in accordance with the present invention.

Referring to FIG. 1, a schematic representation of a postage metering system 100 is shown. The system 100 includes a data center 120 and a plurality of postage meters 140 that are geographically distributed at a variety of customer locations (not shown). The plurality of postage meters 140 are in operative communication with the data center 120 over a global communication network, such as the Internet 160. The plurality of postage meters 140 may connect to the Internet 160 over any suitable communication channels (LAN, WAN, telephone modem, cable modem, T1 communication line, etc.). The data center 120 may be operated by the postage meter manufacturer and/or the postal authority. Typically, the data center 120 tracks the account information (location, contact information, funds information, etc.) for each of the plurality of postage meters 140, conducts remote inspections and provides postage downloads to the plurality of postage meters 140.

The plurality of postage meters 140 are generally for printing a postal indicium 30 on a mail piece 20 (envelope, post card, package, label or the like). The postage meters 140 may take on a variety of configurations. Thus, the plurality of postage meters 140 may include both an open system type postage meter 140*a* and a closed system type postage meter 140*b*. Generally, the open system type postage meter 140*a* includes a personal computer 142*a* suitably connected to the data center 120 and a general purpose office printer 144*a*. Since the open system type postage meter 140*a* may be of any conventional architecture, such as the CLICKSTAMP® Online internet postage system available from Pitney Bowes Inc. of Stamford, Conn., a detailed discussion of the open system type postage meter 140*a* is not necessary for an understanding of the present invention. On the other hand, the closed system type postage meter 140*b* typically includes a dedicated printer and other proprietary hardware and software systems. Here again, since the closed system type postage meter 140*b* may be of any conventional architecture, such as the GALAXY® mailing machine or the DM300™ digital mail processor, both available from Pitney Bowes Inc. of Stamford, Conn., a detailed discussion of the closed system type postage meter 140*b* is not necessary for an understanding of the present invention.

Although the present invention may be implemented with either a closed system type of postage meter 140*a* or an open system type postage meter 140*b*, the remainder of the description will focus on an implementation with the closed system type postage meter 140*b*. Those skilled in the art will recognize that the concepts of the invention are adaptable to either postage meter environment.

Although the data center 120 may be operated by the postal authority itself, the remainder of the description will focus on an implementation where the data center 120 is operated by a postage meter manufacture, or other authorized agency, and communicates periodically with the postal authority 90 over a suitable communication channel 92 (LAN, WAN, telephone modem, cable modem, T1 communication line, internet, etc.). The data center 120 includes a central computer server 122, a data storage system 124 and a locator application 128 where the central computer server 122 is in operative communication with both the data storage system 124 and the locator application 128. The central computer server 122 may be of any conventional combination of computer hardware and software sufficient to execute the postage metering functionality, summarily described above and described in greater detail below, while the data storage system 124 may be of any conventional permanent storage technology (magnetic tape, magnetic disk, optical disk, etc.) so that the data that it contains is readily available to the central computer server 122. The locator application 128, described in greater detail below, determines the physical location of the postage meters 140*a* and 140*b* when they contact the data center 120.

Figure 2:
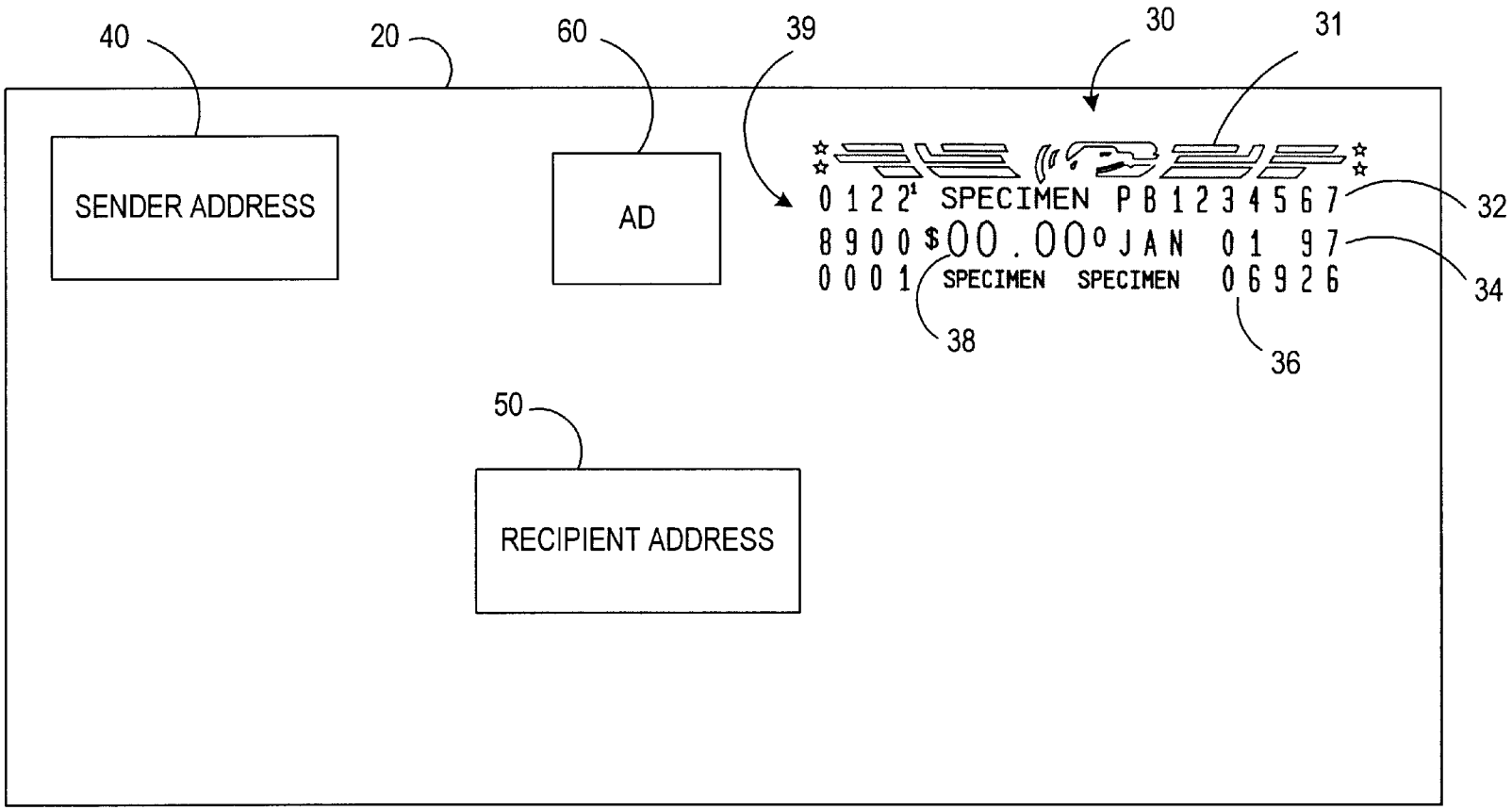
FIG. 2 (PRIOR ART)
FIG. 2 is an example of an envelope having a postal indicium printed thereon in accordance with the prior art.

Referring to FIG. 2, an envelope 20 having an example of a postal indicia 30, a sender address 40 (optional), a recipient address 50 and an ad 60 (an optional greeting or other message) printed thereon is shown. The postage meter 140*b* may or may not print the sender address 40, the recipient address 50 and the ad 60. The postal indicia 30 includes both fixed data that does not change from postal indicium 30 to postal indicium 30 and variable data that may change from postal indicium 30 to postal indicium 30. Generally, the fixed data includes a graphic design 31 (an eagle with stars), a meter serial number 32 uniquely identifying the postage meter (not shown) that dispensed the postage and a location identifier, such as the licensing or receiving post office identifier (Zip code) 36. Generally, the variable data includes a date 34 indicating when the postage was dispensed, a postal value 38 indicating an amount of postage and other data 39 for use by the postal authority in verifying the authenticity of the postal indicia 30 using conventional techniques. However, those skilled in the art will recognize that the exact content of both the fixed data and variable data is subject to regulation by the postal authority and a matter of design choice. As an example, any format (numeric, alpha-numeric, bar code, other symbology and the like) may be employed for the verification data 39 or other components of the postal indicium 30. Therefore, those skilled in the art will recognize that the exact configuration of the postal indicium 30 is not limited to that described above.

Figure 3:
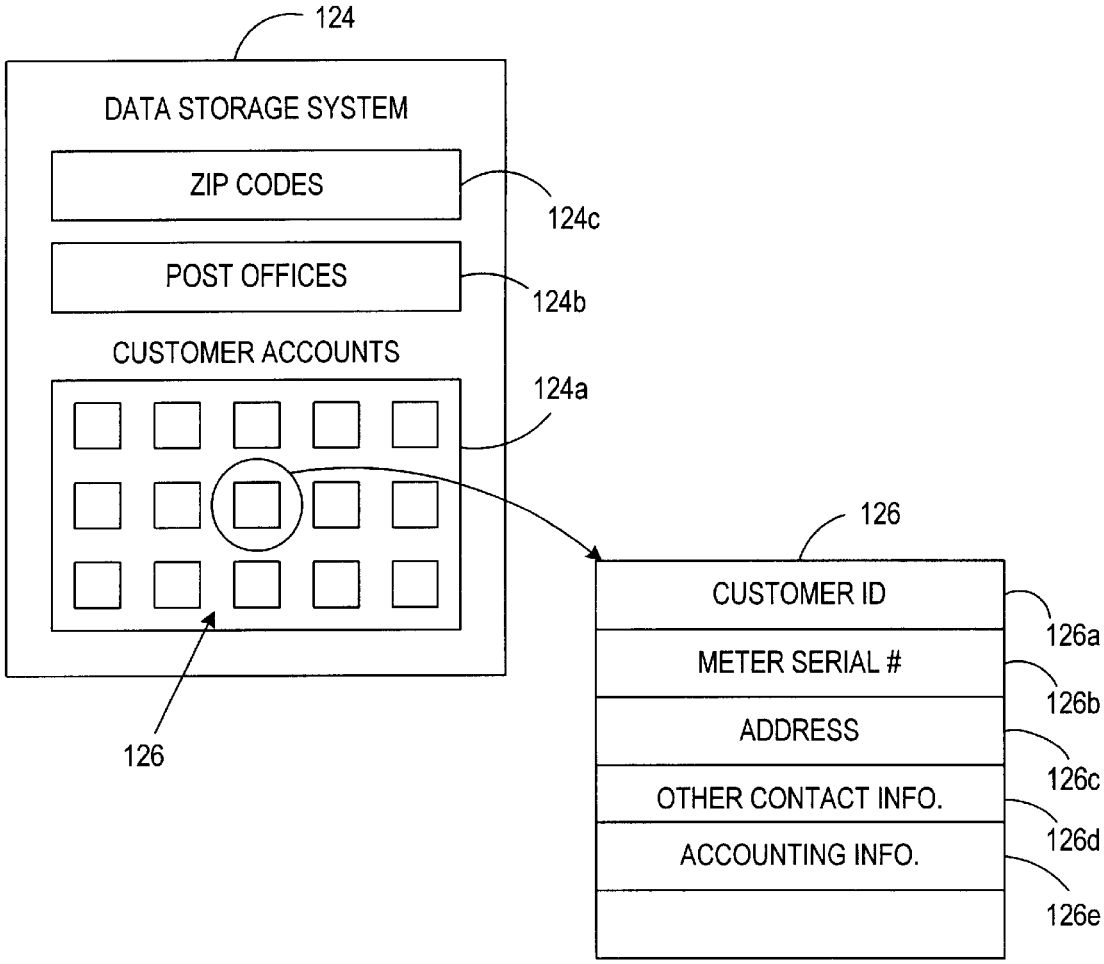
FIG. 3 is a schematic representation of a data storage system that is part of a data center included within the postage metering system in accordance with the present invention.

Referring to FIG. 3, in view of FIGS. 1 and 2, a more detailed schematic diagram of the data storage system 124 is shown. The data storage system 124 includes a customer account database 124*a* including a plurality of customer account files 126, a post offices directory database 124*b* (optional) and a Zip codes directory database 124*c* (optional). The post offices directory database 124*b* includes contact information, such as addresses, telephone numbers and directions, for the various post offices, while the Zip codes directory database 124*c* includes a searchable index that correlates a physical location (address) to a particular Zip code that corresponds to that physical location.

Each of the plurality of customer account files 126 includes an account identifier (numeric, alpha-numeric, etc.) 126*a*, a list of postage meter serial numbers (one or more) 126*b* associated with the account identifier 126*a* (a single customer may have one or more postage meters), a customer address 126*c* (street/town/state, etc.), other customer contact information 126*d* (names, telephone numbers, e-mail addresses, etc.) and accounting information 126*e*. The postage meter serial numbers 126*b* correspond to the meter serial number 32 that is printed in the postal indicium 30. The customer address 126*c* corresponds to the location where the postage meter 140*b* has been licensed for use. Thus, it is anticipated by the postal authority and the postage meter manufacturer that the postage meter 140*b* remains at this designated location until the customer seeks permission to move the postage meter 140*b*. The accounting information 126*e* includes meter register (ascending, descending, etc.) data and reset activity data including a reset dates and reset amounts associated with postage recharge (download) operations. Thus, a historical log of an amount of postage that has been purchased by the postage meter 140*b* is maintained. Those skilled in the art will recognize that the account identifier 126*a* and the postage meter serial numbers 126*b* may be collapsed into a single identifier that serves to identify the customer.

With the structure of the present invention described as above, the operational characteristics will now be described with respect to a typical transaction session initiated by the user between the data center 120 and that is via the postage meter 140*b*. Generally, the transaction session may be a postage recharge operation, a remote inspection operation, an account status inquiry or any other communication between the postage meter 140*b* and the data center 120. Referring primarily to FIGS. 4A and 4B while referencing the structure of FIGS. 1, 2 and 3, a flow chart 400 of the general operation of the postage meter system 100 having location detection capability in accordance with the present invention and a flow chart 450 of an update procedure executed by the data center 120 in accordance with the present invention are shown, respectively.

At 402, a user initiates a transaction session by connecting the postage meter 140*b* with the data center 120 via the Internet 160 and suitably logging on (i.e. ID and optionally a corresponding password). Next, at 404, the data center 120 retrieves the customer account file 126 corresponding to the user. Next, at 406 and 408, using the locator application 128, the data center 120 conducts a locator diagnostic procedure to determine an actual location from which the user is connecting to the data center 120. The locator application 128 may employ techniques such as sending "homing" signals back and forth between the postage meter 140*b* and the data center 120 along different routes 165 through the Internet 160 and using the corresponding transmission times or other communication parameters associated with the homing signals to triangulate the physical location of the postage meter 140*b*. As examples, the locator application 128 may employ available techniques such as: GEOPOINT™ geographic targeting capability available from Quova Inc. of Redwood City, Calif. or TRACEWARE™ geographic intelligence available from Digital Island of San Francisco, Calif. to conduct the location determination. Next, at 410, a determination is made whether or not the actual location determined by the locator application 128 is consistent with a designated location, namely, the address 126*c* from the customer data file 126. If the answer at 410 is yes, then at 412 the data center 120 proceeds with the transaction. On the other hand, if the answer is no, then at 414 the data center 120 executes the update routine 450 before proceeding with the transaction at 412.

The update routine 450 is primarily focused on updating the customer account file 126 with the actual address, updating the postage meter 140*b* as necessary to ensure that the postage meter 140*b* is in compliance with postal authority regulations and notifying the postal authority as necessary of the updates. At 452, the data center 120 prompts the user via the postage meter 140*a* to confirm the actual (determined) location as a new location for the postage meter 140*b*. Next, at 454, a determination is made whether or not the user has confirmed the actual location. The user may confirm this my accepting the actual location as the new location or by changing the address in a manner that is consistent with the actual location (i.e. adding suite numbers, delivery names or other special address designations). However, the user is most preferably not allowed to change the address in a manner that is inconsistent with the actual location. Thus, suggested modifications by the user that are inconsistent are disallowed. Examples of inconsistencies are: discrepancies between the actual town or state and the town or state that is entered by the user. If at 454 the answer is no, then at 456 the data center 120 flags the postage meter 140*b* as lost or stolen and terminates the session. The answer may be deemed "no" in response to refusal of the user to enter an address, termination of the session by the user before entering an address or any other less than satisfactory response from the user. The data center 120 may also take further action such as notifying the postal authority of the serial number 126*b* of the lost/stolen postage meter 140*b* and dispatching an investigator to follow up with locating and retrieving the postage meter 140*b*.

Figure 5A:
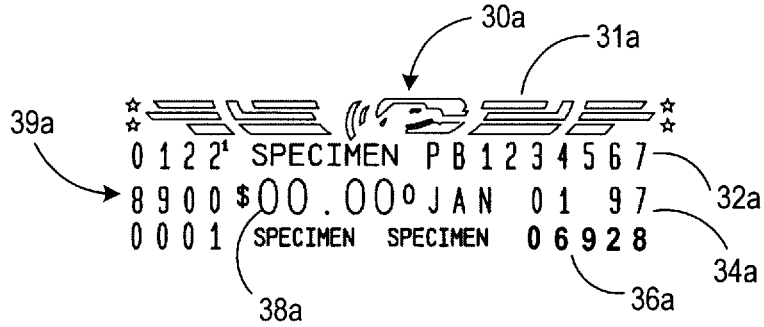
FIGS. 5A, 5B and 5C show examples of how the postal indicium may be modified following the update procedure in accordance with the present invention.
Figure 5B:
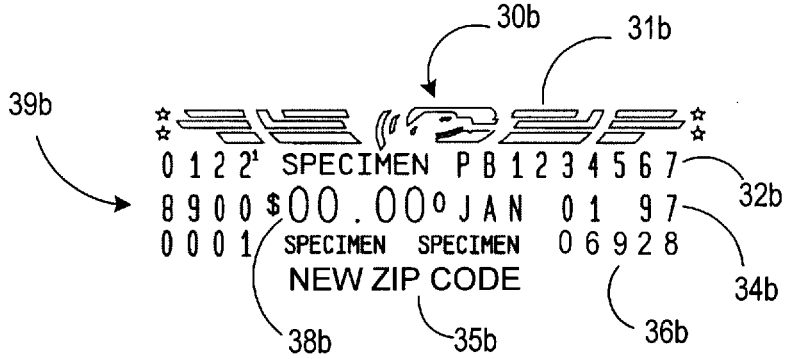
Figure 5C:
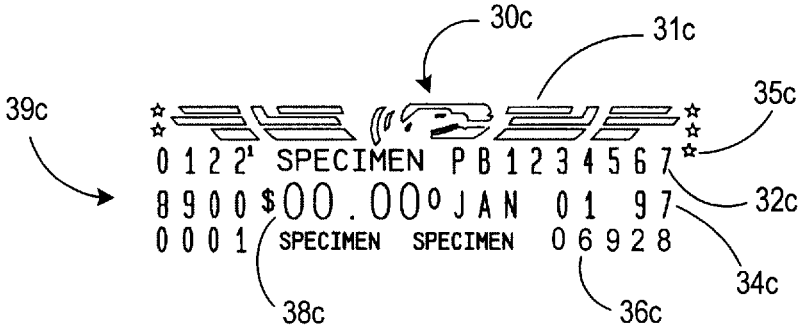

On the other hand, if at 454 the answer is yes, then the data center 120 continues with the update routine 450 and performs various updates. At 458, the data center 120 updates the address 126*c* in the customer file 126 with the actual location. Next, at 460, the data center 120 performs any updates on the postage meter 140*b*, as necessary. For example, if the postage meter 140*b* has moved, but remained within the same Zip code 36, then the graphic elements of the postal indicium 30 need not be changed. However, as another example, if the postage meter 140*b* has moved outside of its original Zip code 36, then the Zip code 36 needs to be updated. Using the Zip codes directory database 124*c* and the actual location, the data center 120 may determine a new Zip code 36 corresponding to the actual location and download new graphics to the postage meter 140*b* to effect a change in the Zip code 36 portion of the postal indicium 30. As an additional option, the data center 120 may download new graphics to the postage meter 140*b* that include a change indicator to provide a marker resident within the postal indicium 30 that the Zip code 36 portion of the postal indicium 30 has been changed. Referring to FIGS. 5A, 5B and 5C in view of FIGS. 1, 2, 3, 4A and 4B, examples of change indicators are shown. In these examples, it is assumed that the Zip code 36 shown in FIG. 2 has changed from "06926" to "06928" as shown in FIGS. 5A, 5B and 5C. In FIG. 5A, the Zip code 36*a* is shown in bold. In FIG. 5B, the Zip code 36*b* is shown in regular type. However, a text based message "new zip code" 35*b* (discernable and understood by the user) has been added to the postal indicium 30*b* indicating that the Zip code 36*b* is new. In FIG. 5C, the Zip code 36*c* is shown in regular type. However, a graphical change (an extra star) 35*c* (less discernable and not readily identifiable by the user as related to the update) has been made to the fixed portion of the postal indicium 30*c*. Those skilled in the art will recognize that many alternatives (human readable, machine readable, etc.) exist for including a change indicator within the postal indicium 30. In the most preferred embodiment, the change indicator may be taken randomly for a plurality of different change indicators or tied to a predetermined parameter, such as the date of the transaction session. Postal indicium embodiments 30*a*, 30*b*, and 30*c* generally include fixed data that includes a graphic design 31*a*, 31*b*, 31*c* (an eagle with stars), a meter serial number 32*a*, 32*b*, 32*c* uniquely identifying the postage meter (not shown) that dispensed the postage and a location identifier, such as the licensing or receiving post office identifier (Zip code) 36*a*, 36*b*, 36*c*. Generally, the variable data includes a date 34*a*. 34*b*, 34*c* indicating when the postage was dispensed and a postal value 38*a*, 38*b*, 38*c* indicating an amount of postage and other data 39*a*, 39*b*, 39*c*.

Referring again to FIGS. 4A and 4B while referencing the structure of FIGS. 1, 2, 3, 5A, 5B and 5C, the data center 120 follows 460 by updating the postal authority 90 as necessary at 462 concerning the actual location. Depending upon postal authority regulations and requirements, this update may be by e-mail or some other form of communication and may involve a re-registration of the postage meter 140*b*. Next, at 464 the data center 120 prompts the user to select other additional services. Next, at 466 the data center 120 executes the additional services selected by the user. An example of an additional service is facilitating filing of a change of address form with the postal authority 90. Even though the postage meter 140*b* location has been updated with the postal authority 90, this only relates to outgoing mail. Therefore, the postal authority 90 will continued to deliver incoming mail to the old address. The data center 120 may file the change of address form with the postal authority 90 on behalf of the user. Alternatively, the data center 120 may download a printable change of address form to the postage meter 140*b* that most preferably already has the data entry fields (old address, new address, new local post office address, etc.) filled out so that the user may file it with the postal authority 90. Another example of an additional service is providing contact information for the post office that corresponds to the actual location. Using the post offices directory database 124*b* and the actual location, the data center 120 can retrieve the contact information (telephone number, address, driving directions, hours of operation, etc.) for the local post office that the postal authority 90 has designated for serving the territory where the postage meter 140 now resides.

Those skilled in the art will now recognize that the present invention substantially addresses many of the drawbacks and deficiencies associated with conventional mail processing in addition to those discussed above. Since the Internet 90 is a public network, the postage meter manufacture does not have the expense of building significant infrastructure. Many other postage meter location systems require the addition of complex and costly proprietary systems to the postage meter 140*b*. Since the transactions are not completed before the locations are verified, the overall postage meter system 100 is more secure (address is verified before postal funds are downloaded or sensitive account data is made available) and contains more accurate information. By combining the address verification with the user initiated transaction, it is more efficient (less disruptive) for the user and the postage metering system 100.

Those skilled in the art will recognize that various modifications can be made without departing from the spirit of the present invention. For example, a series of central postal data centers 120 in communication with each other could be set up to share and distribute verification tasks. As another example, those skilled in the art will recognize that many of the steps and activities described above with respect to the routines 400 and 450 may be performed in differing orders or even concurrently. As yet another example, the control of the various steps and activities described above may be shared or moved between the data center 120, the postal authority 90 and the postage meter 140*b* according to existing postal regulations and other design choices. As yet still another example, in some open system postage meter environments, the graphic data for the postal indicium 30 may not reside at the postage meter. In contrast, the data center 120 may download suitable print driver signals to the printer after generating the digital tokens necessary to verify the authenticity of the postal indicium 30. This is also true of the change indicator. Thus, no updating of the graphic data at the postage meter 140*a* is necessary in response to a relocation of the postage meter 140*a*. Merely identifying that the postal indicium 30 needs to change is relevant. Exactly how the changes are implemented for printing is open to various implementations depending on the architecture of the postage meter 140*a* and 140*b*. As yet still another example, in some contemplated open system postage meter environments, the postage meter manufacturer may hold a batch of serial numbers and allocate them to users during the transaction session (dynamically or otherwise).

Therefore, the inventive concept in its broader aspects is not limited to the specific details of the preferred embodiments but is defined by the appended claims and their equivalents.

What is claimed is:

1. A postage meter system, comprising:

a postage meter registered to a specific customer at a designated location for printing a postal indicium on a mail piece; and a data center remotely located from the postage meter, the data center including a locator application and a customer account file corresponding to the postage meter, the customer account file including specific customer identification data and designated location data; and wherein:

the postage meter is in selective operative communication with the data center via the internet for establishing a transaction session with the data center; and during the transaction session, the data center:

(i) employs the locator application to send homing signals back and forth between the postage meter and the data center along different routes through the internet and using a communication parameter associated with the homing signals to triangulate an actual location of the postage meter;

(ii) compares the actual location with the designated location; and (iii) initiates updates to the postage meter system if the actual location and the designated location do not correspond.

2. The postage meter system of claim 1, wherein:

if the actual location and the designated location do not correspond, the data center solicits an additional service via the postage meter and the additional service is one of the following: filing a change of address form with the postal authority, downloading a change of address form to the postage meter, and providing contact information for a local post office designated by the postal authority and corresponding to the actual address.

3. The postage meter system of claim 1, wherein:

the postal indicium includes a location indicator; and the data center identifies a new location indicator for the postage meter that is representative of the actual location.

4. The postage meter system of claim 3, wherein:

the data center identifies a change indicator for the postage meter that is to be printed along with the postal indicium to indicate that the location indicator has been changed.

5. The postage meter system of claim 4, wherein:

the data center provides updated information to a postal authority representative of the actual location.

6. The postage meter system of claim 5, wherein:

if the actual location and the designated location do not correspond, the data center solicits an additional service via the postage meter and the additional service is one of the following: filing a change of address form with the postal authority, downloading a change of address form to the postage meter, and providing contact information for a local post office designated by the postal authority and corresponding to the actual address.

7. The postage meter system of claim 6, wherein:

if the actual location and the designated location do not correspond, the data center prompts the user via the postage meter to confirm the actual location and allows the user an opportunity to modify the actual location.

8. The postage meter system of claim 7, wherein:

if the user offers a modification to the actual location that is inconsistent with the actual location, then the data center disallows the modification.

9. The postage meter system of claim 8, wherein:

download the new location indicator and the change indicator to the postage meter.

10. A method of operating a postage meter system for printing a postal indicium on a mail piece, the method comprising the step(s) of:

registering a postage meter to a specific customer at a designated location;

maintaining a customer account file corresponding to the postage meter, the customer account file including specific customer identification data and designated location data;

establishing a transaction session between the postage meter and a remotely located data center via the internet; and during the transaction session:

(i) employing a locator application to send homing signals back and forth between the postage meter and the data center along different routes through the internet;

(ii) using a communication parameter associated with the homing signals to triangulate an actual location of the postage meter;

(iii) comparing the actual location with the designated location; and (iv) initiating updates to the postage meter system if the actual location and the designated location do not correspond.

11. The method of claim 10, further comprising the step(s) of:

if the actual location and the designated location do not correspond, soliciting an additional service via the postage meter where the additional service is one of the following: filing a change of address form with the postal authority, downloading a change of address form to the postage meter, and providing contact information for a local post office designated by the postal authority and corresponding to the actual address.

12. The method of claim 10, wherein:

the postal indicium includes a location indicator; and further comprising the step(s) of:

identifying a new location indicator for the postage meter that is representative of the actual location.

13. The method of claim 12, further comprising the step(s) of:

identifying a change indicator for the postage meter that is to be printed along with the postal indicium to indicate that the location indicator has been changed.

14. The method of claim 13, further comprising the step(s) of:

providing updated information to a postal authority representative of the actual location.

15. The method of claim 12, further comprising the step(s) of:

if The actual location and the designated location do not correspond, soliciting an additional service via the postage meter where the additional service is one of the following: filing a change of address form with the postal authority, downloading a change of address form to the postage meter, and providing contact information for a local post office designated by the postal authority and corresponding to the actual address.

16. The method of claim 15, further comprising the step(s) of:

if the actual location and the designated location do not correspond, prompting the user to confirm the actual location; and allowing the user an opportunity to modify the actual location.

17. The method of claim 16, further comprising the step(s) of:

if the user offers a modification to the actual location that is inconsistent with the actual location, disallowing the modification.

18. The method of claim 17, further comprising the step(s) of:

downloading the new location indicator and the change indicator to the postage meter.

19. A method of operating a data center, the method comprising the step(s) of:

maintaining a customer account file corresponding to a postage meter registered to a specific customer at a designated location, the customer account file including specific customer identification data and designated location data, the postage meter for printing a postal indicium on a mail piece;

establishing a transaction session with the postage meter via the internet; and during the transaction session:

(ii) employing a locator application to send homing signals to the postage meter along different routes through the internet;

(ii) using a communication parameter associated with the homing signals to triangulate an actual location of the postage meter;

(iii) comparing the actual location with the designated location; and (iv) initiating updates to the customer account file if the actual location and the designated location do not correspond.

20. The method of claim 19, wherein:

the postal indicium includes a location indicator; and further comprising the step(s) of:

identifying a new location indicator for the postage meter that is representative of the actual location.

21. The method of claim 20, further comprising the step(s) of:

identifying a change indicator for the postage meter that is to be printed along with the postal indicium to indicate that the location indicator has been changed.

22. The method of claim 21, further comprising the step(s) of:

providing updated information to a postal authority representative of the actual location.

23. The method of claim 22, further comprising the step(s) of:

if the actual location and the designated location do not correspond, soliciting an additional service via the postage meter where the additional service is one of the following: filing a change of address form with the postal authority, downloading a change of address form to the postage meter, and providing contact information for a local post office designated by the postal authority and corresponding to the actual address.

24. The method of claim 23, further comprising the step(s) of:

if the actual location and the designated location do not correspond, prompting the user to confirm the actual location; and allowing the user an opportunity to modify the actual location.

25. The method of claim 24, further comprising the step(s) of:

if the user offers a modification to the actual location that is inconsistent with the actual location, disallowing the modification.

26. The method of claim 25, further comprising the step(s) of:

downloading the new location indicator and the change indicator to the postage meter.

27. The method of claim 26, further comprising the step(s) of:

if the modified actual location and the designated location do not correspond, soliciting an additional service via the postage meter where the additional service is one of the following: filing a change of address form with the postal authority, downloading a change of address form to the postage meter, and providing contact information for a local post office designated by the postal authority and corresponding to the actual address.

* * * * *